US005345975A

United States Patent [19]

Sawada

[11] Patent Number: 5,345,975

[45] Date of Patent: Sep. 13, 1994

[54] MULTIPLE WEFT REMOVING DEVICES FOR A LOOM

[75] Inventor: Shigeharu Sawada, Kanazawa, Japan

[73] Assignee: Tsudakoma Kogyo Kabushiki Kaisha, Kanazawa, Japan

[21] Appl. No.: 109,252

[22] Filed: Aug. 20, 1993

[30] Foreign Application Priority Data

Aug. 21, 1992 [JP] Japan ..... 4-222854

[51] Int. Cl.[5] ..... D03D 47/34

[52] U.S. Cl. ..... 139/116.2

[58] Field of Search ..... 139/116.2, 194

[56] References Cited

U.S. PATENT DOCUMENTS 4,730,643 3/1988 Tamatani .
5,129,430 7/1992 Mitsuya ..... 139/116.2
5,199,468 4/1993 Aarts et al. ..... 139/116.2 X

FOREIGN PATENT DOCUMENTS 0309013 3/1989 European Pat. Off. .
0483068 4/1992 European Pat. Off. .
62-141159 6/1987 Japan ..... 139/116.2

*Primary Examiner*—Andrew M. Falik
*Attorney, Agent, or Firm*—Oblon, Spivak, McClelland, Maier & Neustadt

[57] ABSTRACT

A faulty weft yarn removing apparatus for a loom, having weft yarn extracting devices disposed on the picking side and receiving side of a fabric, respectively, capable of removing the faulty weft yarns (Y1, Y2) smoothly even when the phenomena of long pick and broken pick both occur. A control circuit determines the long pick or the broken pick when the yarn signals (S1, S2) transmitted from the weft yarn feelers are present, first actuates a weft yarn extracting device disposed on the picking side and if there is a yarn signal (S2) after a specified time passes, actuates the weft yarn extracting device on the receiving side. The weft yarn extracting device is capable of removing the faulty weft yarn (Y1) to the picking side of the fabric and the weft yarn extracting device is capable of removing the faulty weft yarn (Y2) to the receiving side of the fabric.

4 Claims, 6 Drawing Sheets

Fig. 5

| COLUMN | 1 | 2 | 3 | 4 |
|---|---|---|---|---|
| S3 | NORMAL | — | — | — |
| S1 | PRESENT | NOT PRESENT | PRESENT | NOT PRESENT |
| S2 | NOT PRESENT | NOT PRESENT | PRESENT | PRESENT |
| PICKING CONDITION | NORMAL | SHORT PICK, BENT PICK, BROKEN CHIP | LONG PICK, BROKEN PICK | BROKEN PICK |
| Sm1 | — | OUTPUT | OUTPUT | OUTPUT |
| Sm2 | — | — | OUTPUT | OUTPUT |

MULTIPLE WEFT REMOVING DEVICES FOR A LOOM

BACKGROUND OF THE INVENTION

1. Field of the Invention

The present invention relates to a faulty weft yarn removing apparatus capable of removing a faulty weft yarn smoothly when a picked weft yarn is broken in the fabric so that a so-called broken pick occurs.

2. Description of the Related Art

In a shuttleless loom such as an air jet loom and a water jet loom, a faulty weft yarn removing device is often used to extract the faulty weft yarn from the fabric and perform automatic restart of the loom when a mispick (which refers to a weft yarn which causes a faulty picking phenomenon such as short pick, long pick, bent pick, broken pick by the jet of picking fluid or some other causes, etc.) occurs.

The faulty weft yarn removing apparatus may remove the faulty weft yarn from the receiving side as well as the picking side of the fabric by disposing weft yarn extracting devices on the picking side and the receiving side of the fabric, respectively, so that the apparatus may cope with the mispick even when a picked weft yarn is cut off and broken pick occurs in the fabric (for example, U.S. Pat. No. 4,730,643).

The faulty weft yarn removing apparatus as described above is provided with a first weft yarn feeler which detects a correctly picked weft yarn and a second weft yarn feeler disposed downstream in the picking direction, on the receiving side of the fabric. When the second weft yarn feeler detects the weft yarn, the apparatus determines whether the mispick is long pick or broken pick by simultaneously referring to a measuring signal transmitted from an unwinding detector. Namely, when the measuring signal indicates an error, the faulty weft yarn removing apparatus determines that the mispick is long pick and actuates only the weft yarn extracting device on the picking side in order to remove the faulty weft yarn from the picking side in the direction opposite to the picking direction. When the measuring signal is normal, the faulty weft yarn removing apparatus determines that the mispick is a broken pick and actuates both of the weft yarn extracting devices In order to remove the faulty weft yarn in both directions.

According to the prior art, when long pick and broken pick concur, the weft yarn extracting device disposed on the receiving side is not actuated and the broken end of the faulty weft yarn is not removed. The reason is that because the measuring signal indicates an error, only the weft yarn extracting device on the picking side is actuated to cope with long pick. If the weft yarn extracting device disposed on the receiving side is arranged to be also actuated unconditionally at the same time as the weft yarn extracting device on the picking side, both of the weft yarn extracting devices extract the faulty weft yarn from both sides upon the occurrence of simple long pick without broken pick so that the faulty weft yarn is cut off, and the cut end is sprung back and twisted around wrap yarns. Thus it is extremely difficult to remove the faulty weft yarn. On the other hand, if the apparatus is arranged so as to be able to detect the occurrence of a broken pick in order to avoid such a problem, it is necessary to arrange another special detector in the loom. However, such an arrangement is difficult to realize.

SUMMARY OF THE INVENTION

Accordingly, reflecting the current state of the prior art, an object of the present invention is to provide a faulty weft yarn removing apparatus for a loom, capable of coping with simultaneous occurrence of long pick and broken pick smoothly without attaching any special detector to the loom by providing a control circuit which actuates the weft yarn extracting devices disposed on, respectively, the picking side and the receiving side according to a specified operational sequence.

To this end, the present invention provides a faulty weft yarn removing apparatus for a loom, comprising a first weft yarn extracting device disposed on the picking side of the fabric, a second weft yarn extracting device disposed on the receiving side of said fabric, a first feeler disposed along the picking path of a weft yarn, between said fabric and said second weft yarn extracting device which detects the presence of weft yarn and outputs a signal and, a second feeler disposed on either said picking side or said receiving side of said fabric, said second weft yarn feeler detecting the presence and absence of faulty weft yarn and outputting a signal, and a control circuit connected to receive said signal output from said first weft yarn feeler and said signal output from said second weft yarn feeler, said control circuit actuating one of said first weft yarn extracting device and said second weft yarn extracting device upon receipt of said signal output from said first weft yarn feeler and actuating the other of said first weft yarn extracting device and said second weft yarn extracting device only when said signal output from said second weft yarn feeler does not change.

The control circuit may actuate one of the weft yarn extracting devices and then actuate the other weft yarn extracting device after a specified time.

According to the configuration of the present invention, the control circuit actuates the weft yarn extracting devices disposed on the picking side and the receiving side in a specified operation sequence when a yarn signal is transmitted from the second weft yarn feeler. For example, when there is a change in the condition of the weft yarn located on one weft yarn extracting device after the other weft yarn extracting device is actuated, the control circuit can determine that the mispick is only long pick based on the fact that when one end of the faulty weft yarn is extracted, the other end is moved, because the faulty weft yarn remains continuous. Thus, it is not necessary to actuate the other weft yarn removing device. When there is no change in the weft yarn condition, the control circuit can determine that the faulty weft yarn is cut and the mispick is a broken pick. At this time, each of the faulty weft yarn may be removed in both directions by actuating the other weft yarn extracting device.

Further, the control circuit may achieve the same operation as described above by actuating one weft yarn extracting device after the other weft yarn extracting device is actuated, for example, after a specified time needed for one end of the faulty weft yarn to escape from the other weft yarn extracting device. When the faulty weft yarn continues, all the section of the faulty weft yarn may be removed by the weft yarn extracting device which has been started first. If the faulty weft yarn is cut, both of the end portions thereof may be removed by both of the weft yarn extracting devices.

The above, and other objects, features and advantages of the present invention will become apparent from the following description when the same is read in conjunction with the accompanying drawings, in which like reference numerals designate the same elements.

BRIEF DESCRIPTION OF THE DRAWINGS

FIG. 5 is a table explaining the operation of a determining circuit.

DESCRIPTION OF THE PREFERRED EMBODIMENTS

Figure 1:
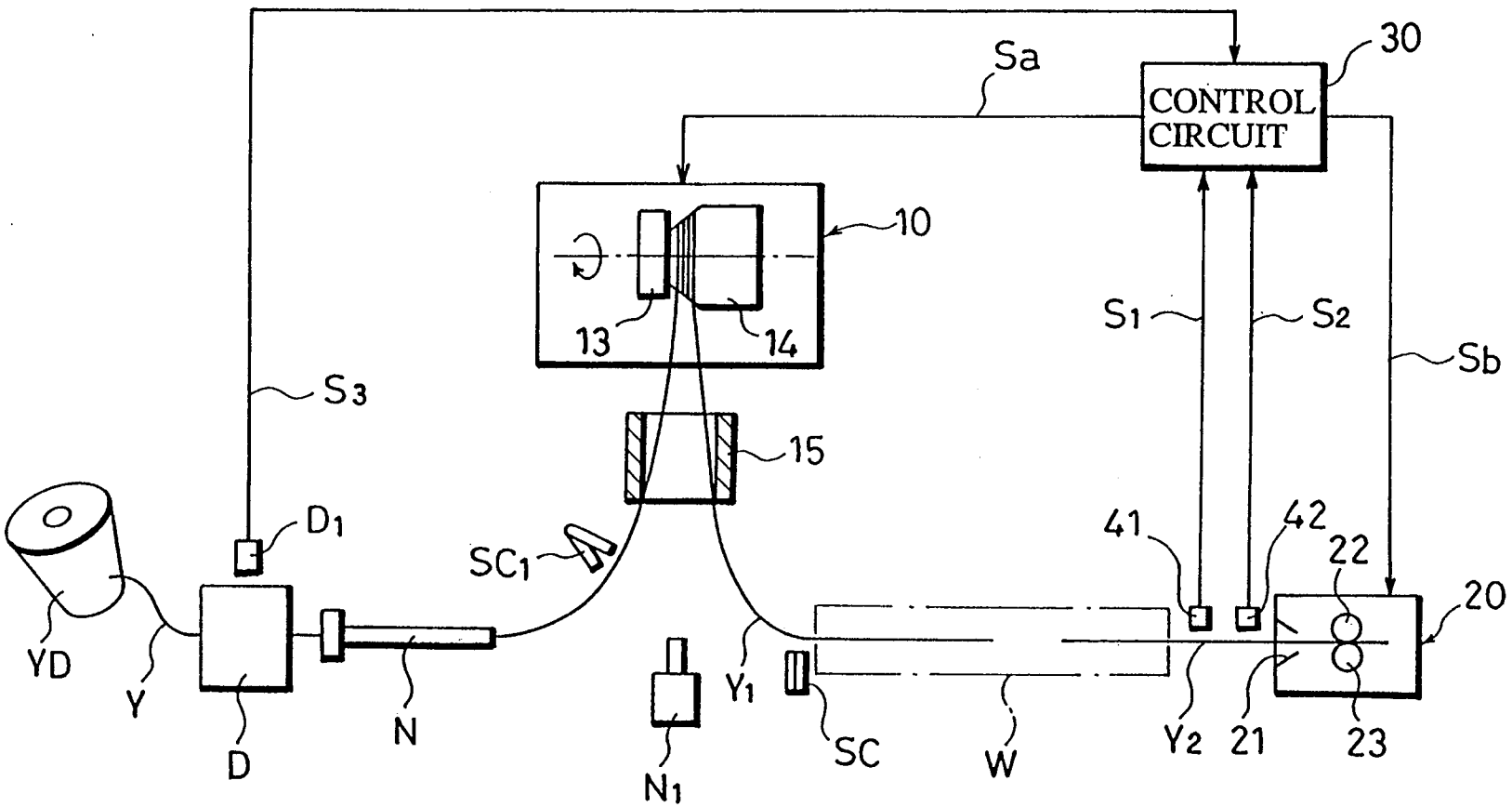
FIG. 1 is a block diagram showing the overall configuration of the present invention.

Referring to FIG. 1, a faulty weft yarn removing apparatus for a loom comprises a first weft yarn extracting device 10, a second weft yarn extracting device 20, disposed on a picking side and a receiving side, respectively, of a fabric and a control circuit 30.

Assuming that the loom is an air jet loom, a weft yarn Y is unwound from a weft supply package YD and introduced to a picking nozzle N through a measuring and storing device D. The measuring and storing device D and the picking nozzle N are actuated at a specified picking timing so as to pick the weft yarn into a shed W. After being properly inserted, the weft yarn Y is beat up by a reed not shown, forming the fabric together with warp yarns. The rear end of the weft yarn is cut by means of a cutter SC to prepare for the next picking.

Figure 2:
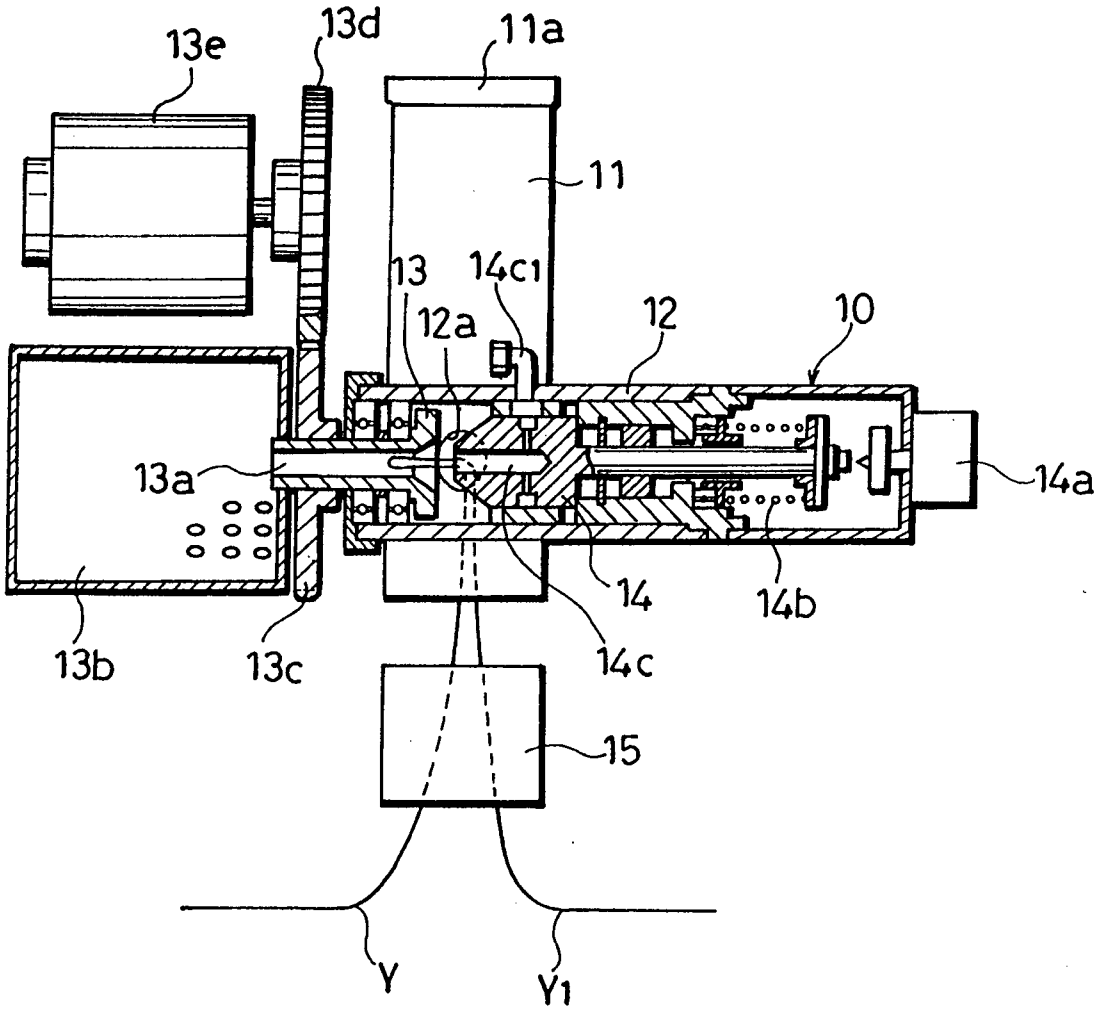
FIG. 2 is a structural drawing showing major parts of a weft yarn extracting device disposed on a picking side of a fabric.

The weft yarn extracting device 10 disposed on the picking side has been disclosed in, for example, U.S. Pat. No. 4,730,643 and outlined as follows (FIGS. 1, 2).

When any faulty picking operation is detected in the picked weft yarn Y, the loom stops immediately. Before the cutter SC is activated, guide nozzle N1 is activated and the weft yarn is supplied from the measuring and storing device D. Thereby the rear end of the faulty weft yarn Y1 may be blown up in the form of a semi-loop into a guide tube 11 through a tubular yarn guide 15 while remaining continuous from the weft yarn Y supplied from the picking nozzle N. Thus the faulty yarn is prevented from being cut by the cutter SC. The yarn guide 15 is disposed just below the guide tube 11 and guides the rear end of the faulty weft yarn Y1. The loom reverses to find the end of the faulty weft yarn Y1.

An air adjusting cap 11*a* is mounted on the top of the guide tube 11 and a tube 12 having a communicating hole 12*a* is connected in the middle of the guide tube 11. The tube 12 contains rotary members 13, 14.

The rotary member 13 has a conical recess at the front end and has a passage hole 13*a* along the axis dimension. Further, the rotary member 13 is provided with a net cage 13*b* at the rear end and may be rotated by a motor 13*e* through gears 13*c*, 13*d*. Another rotary member 14 has a sharp conical end and may be moved forward toward the rotary member 13 through a cylinder 14*a* at the rear end so as to engage with the rotary member 13 (FIG. 1). However, the rotary member 14 is urged backward by a compression spring 14*b* so that it stays sufficiently away from the rotary member 13 when the rotary member 14 is not forwarded (FIG. 2). Additionally, an air nozzle 14*c* is formed at the front end of the rotary member 14.

When the guide nozzle N1 blows up the faulty weft yarn Y1 in the form of the semi-loop into the guide tube 11, and air is supplied to the air nozzle 14*c* in the rotary member 14 through a connector 14*cl*, the air nozzle 14*c* jets air toward the passage hole 13*a* in the rotary member 13 to form a negative pressure near the circumference of the front end of the rotary member 14. After blown into the guide tube 11, the weft yarn Y and the faulty weft yarn Y1 may be sucked into the tube 12 through the communicating hole 12*a* and be blown into the passage hole 13*a* in the rotary member 13 (FIG. 2). Thus, when the rotary member 14 is moved forward by the cylinder 14*a*, the weft yarn Y and the faulty weft yarn Y1 may be nipped between the rotary members 14 and 13. When the rotary member 13 is rotated by the motor 13*e*, the rotary member 14 is rotated jointly with the rotary member 13 so as to extract and wind the weft yarn Y and the faulty weft yarn Y1 (FIG. 1). In this case, before the motor 13*e* is started, the weft yarn Y remaining continuous from the picking nozzle N is cut by means of an auxiliary cutter SC1.

By determining the yarn guide 15 disposal position adequately, the faulty weft yarn Y1 may be extracted and peeled away from the cloth fell of the fabric in a direction almost opposite to the picking direction and then removed from the fabric. When the entire amount of the faulty weft yarn Y1 is removed from the cloth fell, the cylinder 14*a* is shortened so as to retract the rotary member 14 through the compression spring 14*b*. Then, the wound broken weft yarn is discharged to the net cage 13*b* by air supplied from the air nozzle 14*c*, through the passage hole 13*a*.

The loom reverses by an adequate degree to restart from its specified restart position.

Figure 3:
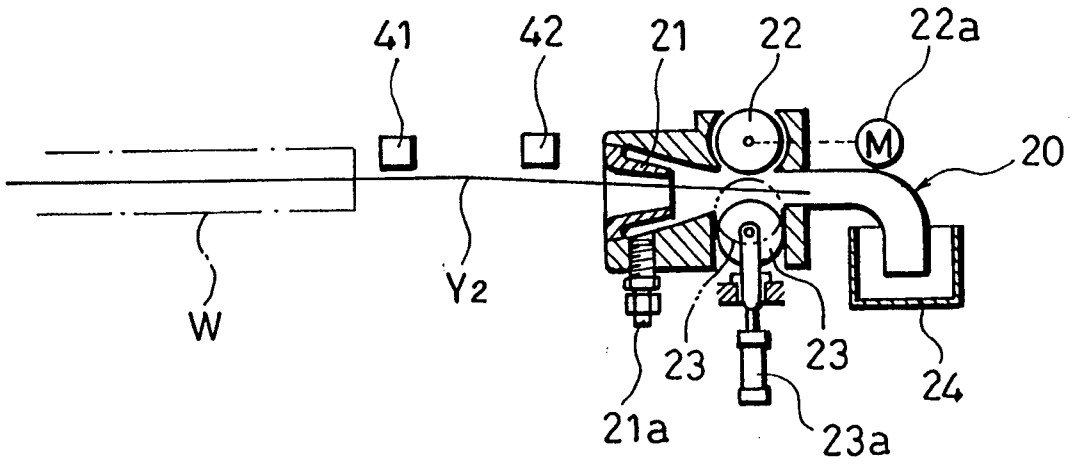
FIG. 3 is a structural drawing showing major parts of a weft yarn extracting device disposed on a receiving side of a fabric.

The receiving-side weft yarn extracting device 20 is the same device as that disclosed in U.S. Pat. No. 4,730,643; when the weft yarn is broken, the device removes the faulty weft yarn Y2 on the receiving side by extracting it from the receiving side in the same direction as the picking direction (FIGS. 1, 3).

The weft yarn extracting device 20 comprises an air nozzle 21 on the front end, a pair of rollers 22, 23 in the intermediate section and a net cage 24 on the rear end. On the other hand, the roller 22 may be driven by a motor 22*a* and another roller 23 may be pressed to the roller 22 through the cylinder 23*a*. The weft yarn extracting device 20 is disposed at a position where correctly picked weft yarn does not reach, with an air nozzle 21 opening in the same direction as the picking path.

When the loom automatically stops because broken pick is detected, air is supplied to the air nozzle 21 through a connector 21*a* so as to suck the faulty weft yarn Y2 into the air-nozzle 21. Then, the loom is reversed to find the broken end of the faulty weft yarn Y2 and the motor 22*a* is started to rotate the roller 22 and the roller 23 is forwarded by the cylinder 23*a*. The rollers 22 and 23 nip the faulty weft yarn Y2 and may extract the faulty weft yarn Y2 in the picking direction. An appropriate yarn guide may be disposed between the fabric and the weft yarn extracting device 20 so as to control the faulty weft yarn Y2 extracting direction.

On the receiving side of the fabric, first and second weft yarn feelers 41, 42 are disposed between the fabric and the weft yarn extracting device 20. The weft yarn feelers 41, 42 are provided with the reed not shown. The former detects the front end of a correctly picked weft yarn Y (hereinafter referred to as the correct weft yarn) and the latter is disposed downstream with regard to the picking path, where the correct weft yarn does not reach so as to detect the faulty weft yarn Y1 when a long pick occurs and the faulty weft yarn Y2 when broken pick occurs.

In addition to yarn signals S1, S2 transmitted from the weft yarn feelers 41, 42, measuring signal S3 is input to the control circuit 30 from an unwinding detector D1 attached to the measuring and storing device D (FIG. 1). The measuring signal S3 indicates the length of the weft yarn Y which is unwound from the measuring and storing device D when picking and being picked. The control circuit 30 outputs driving signals Sa, Sb, which are introduced to the weft yarn extracting devices 10, 20, respectively.

Figure 4:
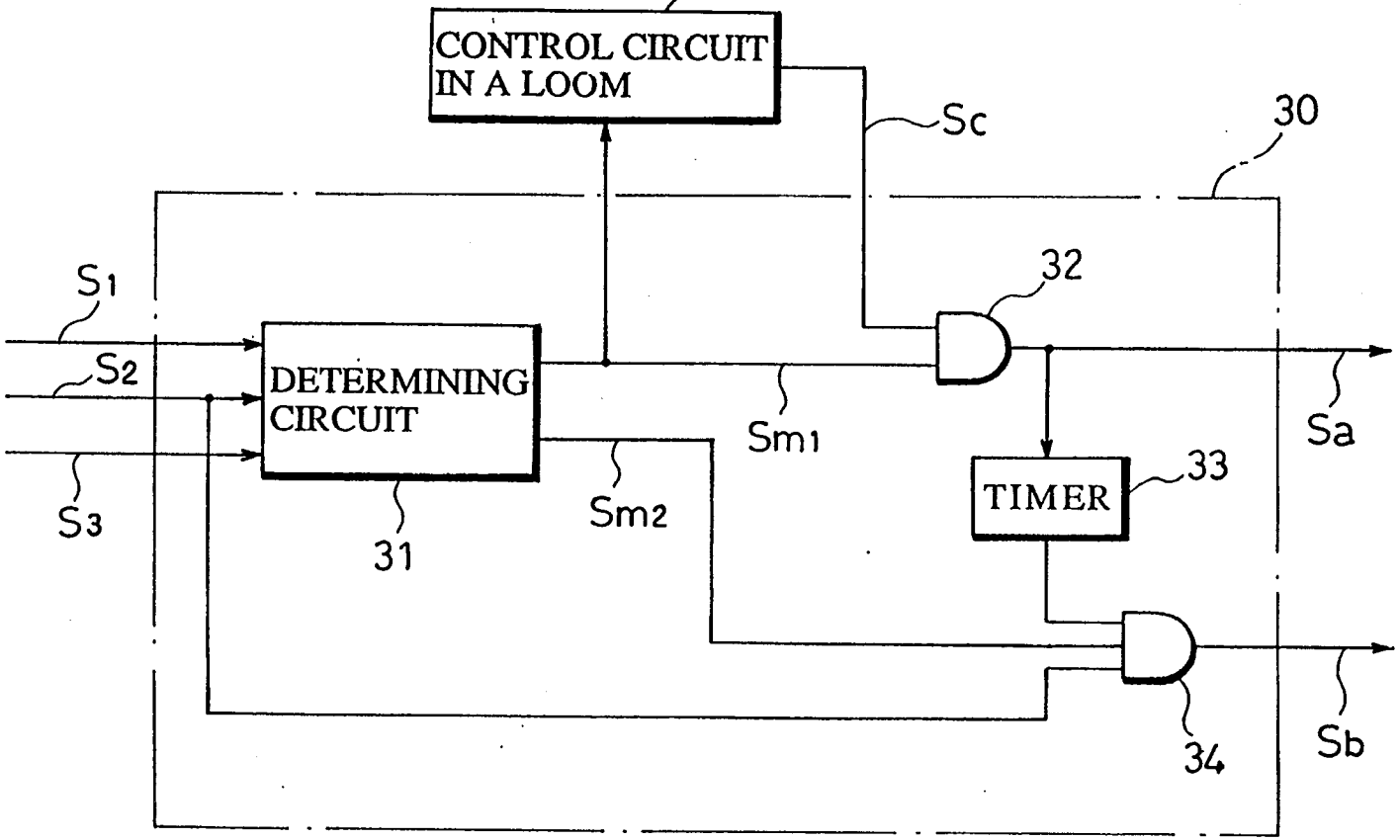
FIG. 4 is a block diagram showing major sections of a control circuit.

The yarn signals S1, S2 and the measuring signal S3 are input to a determining circuit 31 in the control circuit 30 (FIG. 4). The determining circuit 31 outputs mispick signals Sm1, Sm2. The mispick signals Sm1 are branched and input to an outside loom control circuit CC and an AND gate 32 and the output from the loom control circuit CC is also input to the AND gate 32 as stop completion signal Sc. The AND gate 32 outputs the driving signal Sa.

The driving signal Sa is branched and input to an AND gate 34 through a timer 33. In addition to the mispick signal Sm2 transmitted from the determining circuit 31, the yarn signal S2 transmitted from the weft yarn feeler 42 is branched and input to the AND gate 34. The AND gate 34 outputs the driving signal Sb outside.

The determining circuit 31 is operated as follows (FIG. 5).

When the measuring signal S3 transmitted from the unwinding detector D1 is normal, the yarn signal S1 from the first weft yarn feeler 41 is transmitted and no yarn signal S2 from the second weft yarn feeler 42 is transmitted upon the completion of picking, the determining circuit 31 judges that the picking is normal (first column of FIG. 5). Namely, the determining circuit 31 outputs no mispick signal Sm1 or Sm2 at this time, so that the weft yarn extracting devices 10, 20 are not actuated.

When no yarn signals S1 and S2 are provided, the determining circuit 31 judges that short pick, bent pick or broken chip has occurred (second column of the same Figure). Then, the determining circuit 31 outputs the mispick signal Sm1.

When the mispick signal Sm1 is output, the loom control circuit CC correspondingly makes the loom stop automatically and then reverses the loom so as to find the end of the faulty weft yarn Y1. At the same time, the loom control circuit CC outputs the stop completion signal Sc. The control circuit 30 may output the driving signal Sa through the AND gate 32, so that the picking-side weft yarn extracting device 10 may remove the faulty weft yarn Y1 by extracting it in opposite direction to the picking direction. At this time, the determining circuit 31 outputs no mispick signal Sm2, thus the weft yarn extracting device 20 disposed on the receiving side is not actuated.

When both the yarn signals S1 and S2 from the first and second weft yarn feelers 41, 42 are present, the determining circuit 31 judges that a mispick such as long pick or broken pick has occurred (third column of FIG. 5) and mispick signals Sm1, Sm2 are generated. Therefore, after a series of stop and reverse operations for the loom are completed, the AND gate 32 generates the driving signal Sa corresponding to the stop completion signal Sc transmitted from the loom control circuit CC and the control circuit 30 may actuate the picking-side weft yarn extracting device 10.

Thereafter, the timer 33 generates an output signal after the passage of a specified time so as to open the AND gate. At this time, if there are a yarn signal S2 from the second weft yarn feeler 42, and a mispick signal Sm2, the AND gate 34 outputs the driving signal Sb. On the other hand, when the mispick is long pick and the faulty weft yarn Y1 remains continuous from the picking side to the receiving side, the picking-side weft yarn extracting device 10 is actuated first, so that the faulty weft yarn Y1 is extracted to the picking side and the yarn signal S2 from the second weft yarn feeler 42 diminishes. At this time, the AND gate 34 outputs no driving signal Sb so that the receiving-side weft yarn extracting device 20 is not actuated.

If the mispick is a broken pick, after even if the weft yarn extracting device 10 on the picking side has been actuated, the yarn signal S2 transmitted from the second weft yarn feeler 42 is generated by the faulty weft yarn Y2 remained on the receiving side so that the yarn signal S2 does not diminish. For this reason, the AND gate 34 outputs the driving signal Sb so as to actuate the weft yarn extracting device 20 disposed on the receiving side. The weft yarn extracting device 20 is capable of extracting the faulty weft yarn Y2 to the receiving side and removing it. Namely, the faulty weft yarns Y1 and Y2 may be extracted to the picking side and the receiving side by the weft yarn extracting devices 10, 20, respectively and removed.

Although the determining circuit determines whether a long pick has occurred when the yarn signal S2 diminishes, it may also determine that the long pick has been generated when the yarn signal S1 diminishes.

In the description above, if there is a yarn signal S2 from the second weft yarn feeler 42 after the passage of a specified time after the picking-side weft yarn extracting device 10 is actuated by the driving signal Sa, the AND gate 34 outputs the driving signal Sb. Namely, the yarn signal S2 indicates that the faulty weft yarns Y1, Y2 are not moving on the receiving side when the picking-side weft yarn extracting device 10 is actuated. Then, the yarn signal S2 to be input to the AND gate 34 may be substituted with a tension signal S4 transmitted from a tension detector 44 arranged on the receiving side to detect tension T of the faulty weft yarns Y1, Y2 between the fabric and the weft yarn extracting device 20 (FIG. 6).

The tension signal S4 is input to the AND gate 34 through a comparator 35 provided with a setting device 35*a* for setting a setting tension TO. If the mispick is only a long pick, when the device 10 is actuated, the tension T of the faulty weft yarn Y1 which remains continuous up to the picking side changes to $T>TO$ When the mispick is broken pick, the tension T of the faulty weft yarn Y2 located on the receiving side is not changed with the relationship of $T<TO$ maintained.

Then, if the comparator 35 is made to close the AND gate 34 generating no driving signal Sb in the former case and opening the AND gate 34 to generate the driving signal Sb in the latter case, the control circuit 30 may be operated in the same manner as the previous embodiment. It is desirable to keep the air nozzle 21 of the device 20 inactive when the tension T of the faulty weft yarns Y1, Y2 are detected. An appropriate tenser device can be provided on the receiving side of the tension detector to provide the faulty weft yarns Y1, Y2 with resistance.

Figure 6:
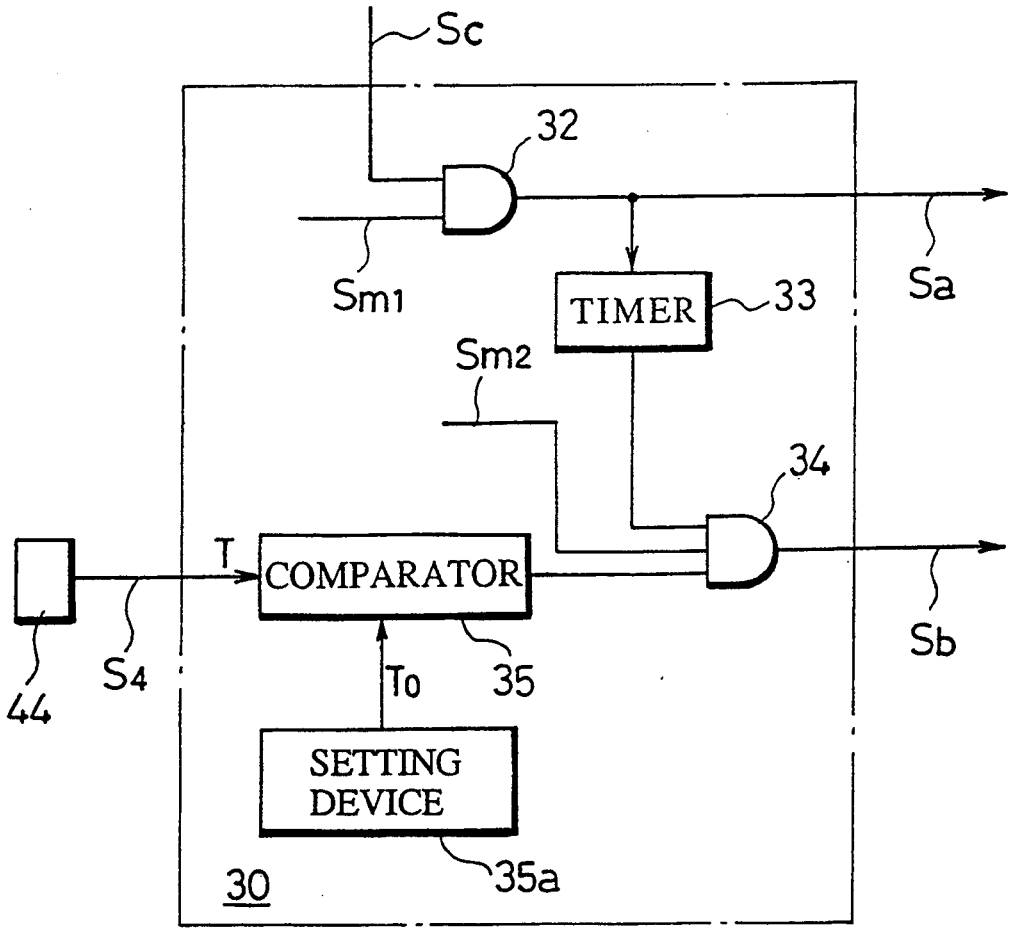
FIG. 6 is a diagram corresponding to FIG. 4, showing another embodiment of the present invention.

The tension detector 44 shown in FIG. 6 may be a speed detector which detects the moving speeds of the faulty weft yarns Y1, Y2. In these embodiments, the operating sequences of the weft yarn extracting devices 10, 20 may be reversed when long pick or a broken pick occurs so that the former is actuated last and the latter is actuated first. In this case, while the device 20 is operating ahead of the device 10, the device 10 does not nip the faulty weft yarn Y1 in between the rotary members 13 and 14 but keeps the weft yarn blown into the passage hole 13*a* of the rotary member 13. Namely, regarding the long pick operation, after either the device 10 or 20 is activated, if the weft yarn condition on the other side is changed, the control circuit 30 must keep only the other device inactive; but regarding the weft yarn breakage condition, if the weft yarn condition on the other device is not changed, the control circuit 30 must also activate the other device.

In another aspect, the control circuit 30 may make either the weft yarn extracting device 10 or 20 activated first and then the other device unconditionally activated after a specified time, when long pick or broken pick occurs. However, when the device 10 is activated first, there must be enough time for the end of the faulty weft yarn Y1 to escape from the device 20.

In this case, the apparatus excludes the signal transmission path as shown in FIG. 4, which inputs the yarn signal S2 into the AND gate 34.

When the device 20 is activated first, the specified time must be sufficient enough for the end of the faulty weft yarn Y1 to escape from the weft yarn extracting device 10 on the picking side. In the latter case, before the device 20 is actuated, the weft yarn must be cut off by means of the auxiliary cutter SC1 at the exit of the nozzle N. Additionally, the specified time interval for actuating the-devices 10, 20 may-be controlled not only by a time measuring means such as a timer but also by monitoring whether a specified number of rotations of the rotary member 13 or roller 22 has been reached.

As described above, the advantage of this invention is that the faulty weft yarn may be removed smoothly without the necessity of attaching any special detector to the loom for detecting broken pick when mispick occurs including a case when a long pick and a broken pick concur, because the control circuit may cope with a long pick by actuating only one weft yarn extracting device or may cope with both a long pick and a broken pick by actuating the both weft yarn extracting devices in time series, by, according to the present invention, providing the weft yarn extracting devices disposed on the picking and receiving sides and the control circuit for controlling the operating sequence of these weft yarn extracting devices when the yarn signal is transmitted from the second weft yarn feeler.

Although the above described embodiment uses the yarn signals S1, S2 to determine whether the mispick is a breakage of the weft yarn or a long pick, and therefore excludes a broken chip from the possible mispick conditions, the embodiment may make the determination using the only yarn signal S2 to simplify the configuration.

What is claimed is:

1. A faulty weft yarn removing apparatus for a loom, comprising:

a first weft yarn extracting device adapted to be disposed on a picking side of a fabric;

a second weft yarn extracting device adapted to be disposed on a receiving side of said fabric;

a first weft yarn feeler adapted to be disposed along a picking path of a weft yarn, between said fabric and said second weft yarn extracting device, said first weft yarn feeler detecting the presence of said weft yarn and outputting a signal;

a second weft yarn feeler disposed on either said picking side or said receiving side of said fabric, said second weft yarn feeler detecting the presence and absence of faulty weft yarn and outputting a signal; and a control circuit connected to receive said signal output from said first weft yarn feeler and said signal output from said second weft yarn feeler, said control circuit actuating one of said first weft yarn extracting device and said second weft yarn extracting device upon receipt of said signal output from said first weft yarn feeler and actuating the other of said first weft yarn extracting device and said second weft yarn extracting device only when said signal output from said second weft yarn feeler does not change.

2. A faulty weft yarn removing apparatus for a loom according to claim 1, wherein said first weft yarn feeler adapted to operate in conjunction with said second weft yarn feeler.

3. A faulty weft yarn removing apparatus for a loom, comprising:

a first weft yarn extracting device adapted to be disposed on a picking side of a fabric;

a second weft yarn extracting device adapted to be disposed on a receiving side of said fabric;

a first weft yarn feeler adapted to be disposed along a picking path of a weft, between said fabric and said second weft yarn extracting device, said first weft yarn feeler detecting the presence of said weft yarn and outputting a signal;

a tension detector adapted to be disposed along either said picking side or said receiving side of said fabric, for detecting a tension of a faulty weft yarn and outputting a signal; and a control circuit connected to receive said signal output from said first weft yarn feeler and said tension detector, said control circuit actuating one of said first weft yarn extracting device and said second weft yarn extracting device upon receipt of said signal output from said first weft yarn feeler and actuating the other of said first weft yarn extracting device and said second weft yarn extracting device only when said signal output from said tension detector does not change.

4. A faulty weft yarn removing apparatus for a loom, comprising:

a first weft yarn extracting device adapted to be disposed on a picking side of a fabric;

a second weft yarn extracting device adapted to be disposed on a receiving side of said fabric;

a first weft yarn feeler adapted to be disposed along a picking path of a weft yarn, between said fabric and said second weft yarn extracting device, said first weft yarn feeler detecting the presence of said weft yarn and outputting a signal; and a control circuit connected to receive said signal output from said first weft yarn feeler, said control circuit actuating one of said first weft yarn extracting device and said second weft yarn extracting device upon receipt of said signal output from said first weft yarn feeler and actuating the other of said first weft yarn extracting device and said second weft yarn extracting device only after a lapse of a predetermined amount of time from receipt of said signal output from said first weft yarn feeler.

* * * * *